US006132300A

United States Patent [19]

Martin

[11] Patent Number: 6,132,300

[45] Date of Patent: Oct. 17, 2000

[54] DUAL FUNCTION OSCILLATING TOOL

[75] Inventor: Michael Martin, Darlington, United Kingdom

[73] Assignee: Black & Decker Inc., Newark, Del.

[21] Appl. No.: 08/876,316

[22] Filed: Jun. 16, 1997

Related U.S. Application Data

[63] Continuation of application No. 08/701,568, Aug. 22, 1996, abandoned, which is a continuation of application No. 08/503,109, Jul. 17, 1995, abandoned.

[30] Foreign Application Priority Data

Jul. 26, 1994 [GB] United Kingdom ..... 9415011

[51] Int. Cl.[7] ..... B24B 23/00

[52] U.S. Cl. ..... 451/357; 451/359

[58] Field of Search ..... 451/357, 359, 451/270, 271, 159, 353

[56] References Cited

U.S. PATENT DOCUMENTS

| | | | |
|---|---|---|---|
| 3,747,280 | 7/1973 | Stroezel et al. | 451/357 |
| 3,862,520 | 1/1975 | Klebe, Jr. et al. | 451/357 |
| 3,862,521 | 1/1975 | Isaksson | 451/359 |
| 3,874,125 | 4/1975 | Stroezel | 451/357 |
| 3,932,966 | 1/1976 | Stern | 451/359 |
| 4,322,921 | 4/1982 | Maier | 451/357 |
| 4,397,120 | 8/1983 | Overy et al. | 451/357 |
| 4,414,781 | 11/1983 | Overy et al. | 451/357 |
| 4,414,782 | 11/1983 | Langenberg | 451/357 |
| 4,468,895 | 9/1984 | Signorelli . | |
| 4,625,462 | 12/1986 | Fushiya . | |
| 4,660,329 | 4/1987 | Hutchins | 451/357 |
| 4,708,041 | 11/1987 | Granger . | |
| 4,729,194 | 3/1988 | Maier . | |
| 4,744,177 | 5/1988 | Braun . | |
| 4,754,575 | 7/1988 | Schneider . | |
| 5,018,314 | 5/1991 | Fushiya et al. . | |
| 5,056,268 | 10/1991 | Wolff . | |
| 5,261,190 | 11/1993 | Berger et al. | 451/357 |
| 5,317,838 | 6/1994 | Bourner . | |
| 5,384,984 | 1/1995 | Smith . | |
| 5,392,568 | 2/1995 | Howard, Jr. et al. . | |
| 5,398,454 | 3/1995 | Berner . | |
| 5,398,457 | 3/1995 | Updegrave et al. . | |
| 5,441,450 | 8/1995 | Fein et al. . | |
| 5,470,272 | 11/1995 | Kikuchi et al. . | |
| 5,679,066 | 10/1997 | Butz et al. . | |

FOREIGN PATENT DOCUMENTS

| | | |
|---|---|---|
| 3805926 | 9/1989 | Germany . |
| 4118392 | 12/1992 | Germany . |

*Primary Examiner*—Eileen P. Morgan
*Attorney, Agent, or Firm*—Bruce S. Shapiro; John D. Del Ponti; Michael P. Leary

[57] ABSTRACT

A dual function powered oscillating hand tool includes a drive unit 5 having an electric motor 2 and a first drive shaft 7. A bearing 15 is mounted on the first drive shaft 7 and is located radially eccentrically relative to the first drive shaft. A second drive shaft 14 is mounted on the eccentric bearing 15. A sanding head may be mounted on the second shaft 14 and may include a sanding platen 21 for random orbit sanding or a sanding shoe 20 for regular orbital sanding. Each of a first flexible group of elements, which include columns 16, pegs 50 and hollow legs 80, and each of a second group of mating elements, which include slotted posts 3, a slotted groove 58 and bosses 72, respectively, are provided for restricting the random orbit of the sanding shoe 20 to a regular orbit. The respective elements of one group may be mounted on the shoe 20 and the respective elements of the other group maybe mounted on the driving unit 5.

10 Claims, 4 Drawing Sheets

DUAL FUNCTION OSCILLATING TOOL

This is a Continuation of application Ser. No. 08/701,568 filed Aug. 22, 1996, now abandoned, which is a continuation of application Ser. No. 08/503,109, filed Jul. 17, 1995, now abandoned.

BACKGROUND TO THE INVENTION

The present invention relates to a powered oscillating hand tool comprising a drive unit having an electric motor with a drive shaft to which a sander head can be attached. In general, known sanders can be described as either random orbit sanders or orbital sanders.

In random orbit sanders, a circular platen is driven by a drive system which comprises an eccentric bearing so that the platen can spin independently of the motor, and the platen describes a random orbit. Such sanders are in general used for the removal of relatively large quantities of material. Alternatively, the sander may be of the orbital type, with a shaped shoe, the drive system of which comprises an eccentric which is restrained so that the sander shoe cannot spin independently of the motor and it therefore describes a regular orbit. The shoes of such sanders are available in a range of shapes and such sanders are in general used for the removal of relatively small quantities of material, for example for detailed work or for finishing. By choice of a suitably shaped shoe, it is possible to access areas which are inaccessible with a random orbit sander. The fixed eccentric drive system of the orbital sander is cheaper and simpler to manufacture than the eccentric bearing of the random orbit sander.

Known sanders have been either of the random orbit type or the orbital type, which has meant that when the user wished to have the ability to perform both coarse and detailed sanding operations, it has been necessary for him to purchase two separate units, one of each type, or to purchase only one unit and suffer the disadvantages thereof.

It is an object of the present invention to provide a sander in which the above disadvantages are reduced or substantially obviated.

BRIEF SUMMARY OF THE INVENTION

The present invention therefore provides a dual function powered oscillating hand tool comprising (i) a drive unit having an electric motor and a drive shaft;

(ii) a bearing mounted on the drive shaft and located radially eccentrically relative to the drive shaft;

(iii) a second drive shaft mounted in the eccentric bearing and (iv) means for mounting a sanding platen or shoe on the second drive shaft characterized in that the sanding head may comprise a sanding platen for random orbit sanding or a sanding shoe for orbital sanding and in that the tool further comprises means selectively engageable to restrict the random orbit of the sanding shoe to a regular orbit.

BRIEF DESCRIPTION OF THE SEVERAL VIEWS OF THE DRAWINGS

The invention will now be further described with reference to the accompanying drawings in which.

DETAILED DESCRIPTION

Figure 1:
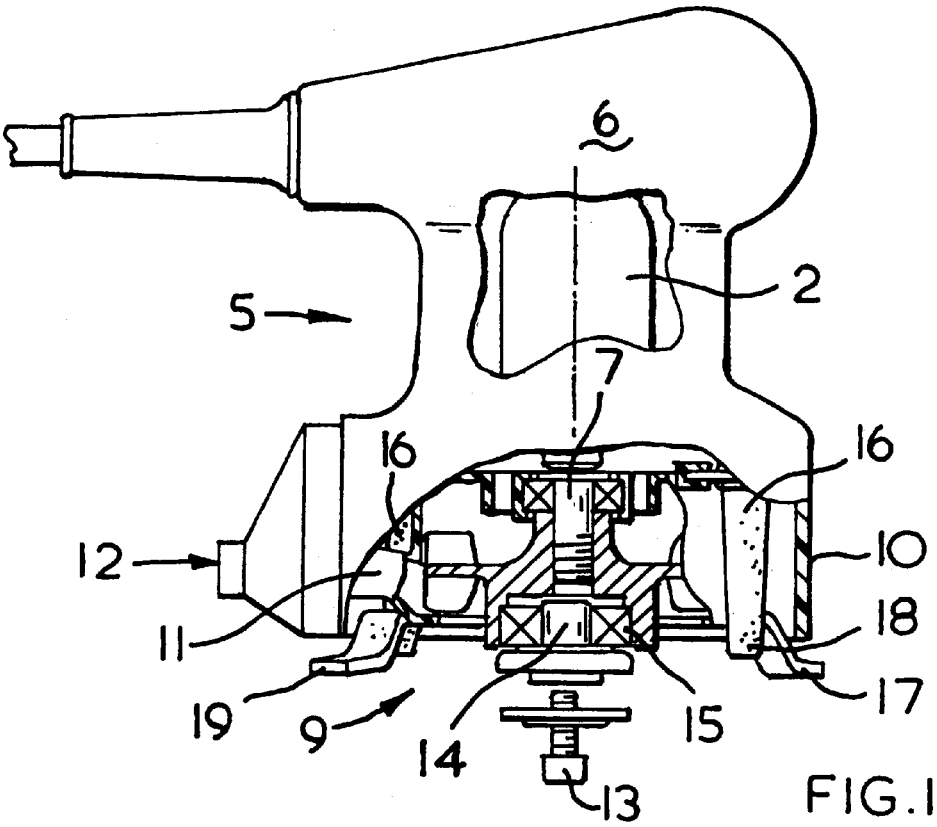
FIG. 1 is a side view, partially in section, of the drive unit of a first embodiment of a hand tool according to the present invention, shown without an operating head.

FIG. 1 shows a drive unit (5) including an electric motor (2) located in upper housing (6) and driving shaft (7). A fan (8) mounted on shaft (7) is arranged to draw air in from mouth (9) of lower housing (10) and direct it through extractor duct (11) to exhaust outlet (12). A nut (13) is used to secure operating heads (see FIGS. 2 and 3) to shaft (14) which is housed in the fan (8) by bearing (15) which is eccentrically located radially in respect to shaft (7).

Two pairs of hollow, tapering, flexible columns (16) made of rubber are arranged around the mouth (9) of the lower housing (10). Each flexible column (16) has a more flexible angled leg (17) projecting from the column (16) a short distance from the tip (18) so that in the unstressed position the end (19) of the leg (17) projects beyond the tip (18) of the column (16).

Figure 2:
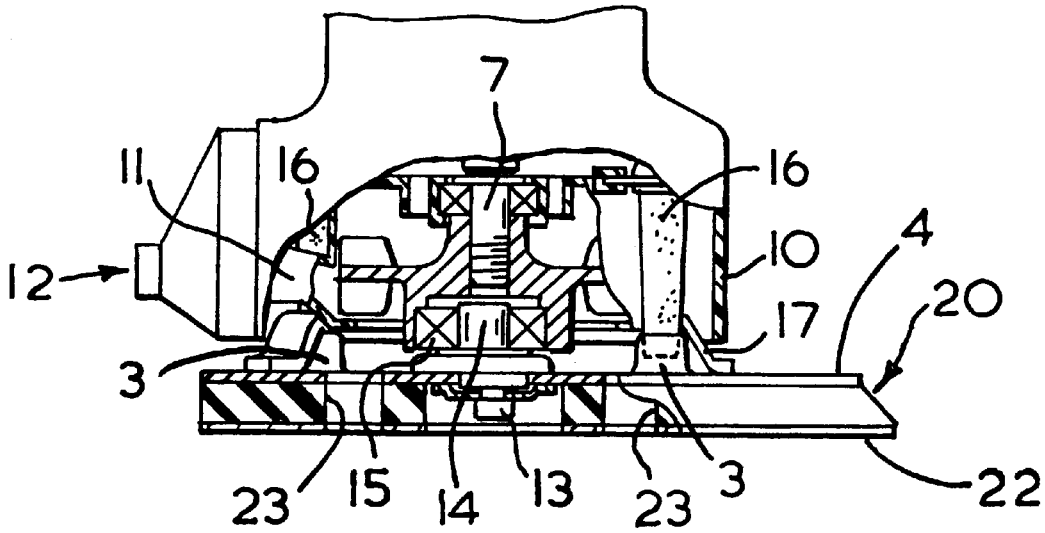
FIG. 2 is a side view of the lower part of the drive unit of FIG. 1 when fitted with an orbital sander shoe.
Figure 3:
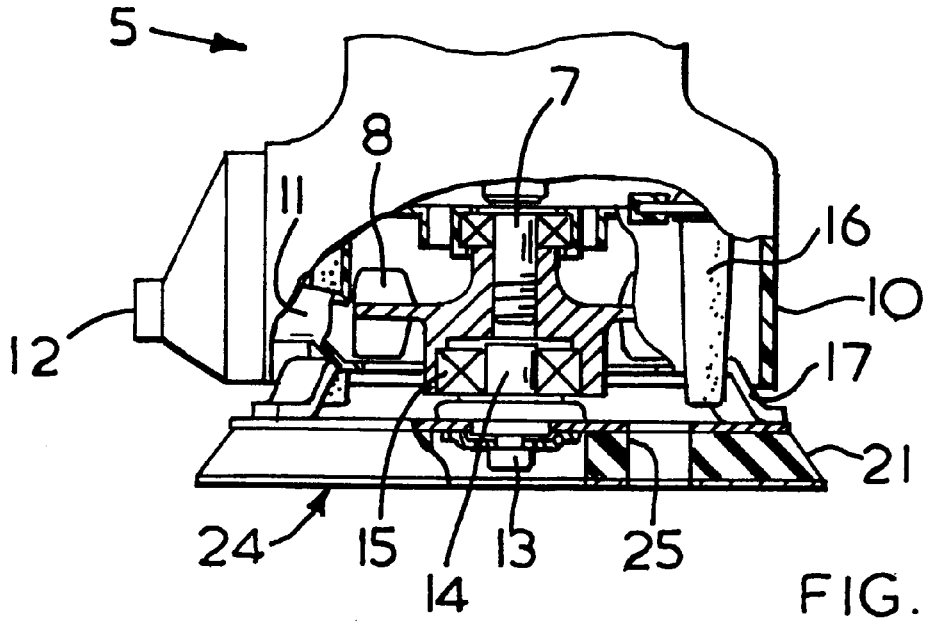
FIG. 3 is a side view of the lower part of the drive unit of FIG. 1 when fitted with a random orbit sander platen.

Drive unit (5) can alternatively be fitted with an (oscillating) orbital sander shoe (20), (FIG. 2) or with a random orbit sander platen (21) (FIG. 3).

As seen in FIG. 2, shoe (20) is supported by tips (18) of the flexible columns (16) which fit into slotted posts 3 formed on an upper surface 4 of the shoe, is driven by the electric motor (2) (FIG. 1) through shafts (7,14). The angled legs (17) in this case are deflected from the flexible columns (16) to lie level with the upper surface (4) of the shoe (20). A perforated sandpaper sheet (not shown) may be attached to the outer face (22) of the shoe (20), for example by the use of hook-and-loop fabric such as that sold as VELCRO (RTM) glued to face (22). Holes (23) passing through the shoe (20) facilitate the removal of dust etc, from the sanding face through the shoe (20) to exhaust outlet (12) via the duct (11). An extractor hose (not shown) may be attached to the exhaust outlet (12).

As seen in FIG. 3, platen (21) is driven by the electric motor (2) (FIG. 1) by means of shafts (7,14).

Again, a perforated sandpaper sheet (not shown) may be attached to the outer face (24) of the platen (21), for example by the use of hook-and-loop fabric glued to the face (24). Holes (25) passing through the platen (21) again facilitate removal of dust etc, through the platen (21) to exhaust outlet (12). In this case, tips (18) of the flexible columns (16) are held away from the platen (21) so that the ends (19) of the angled legs (17) contact the platen (21). In operation, ends (19) of legs (17) drag against the rotating platen (21) to exert a braking effect.

The invention thus provides a powered oscillating power tool which can easily be fitted with an orbital sander head or with an efficiently braked random orbit sander head without requiring adjustment to the drive.

Figure 4:
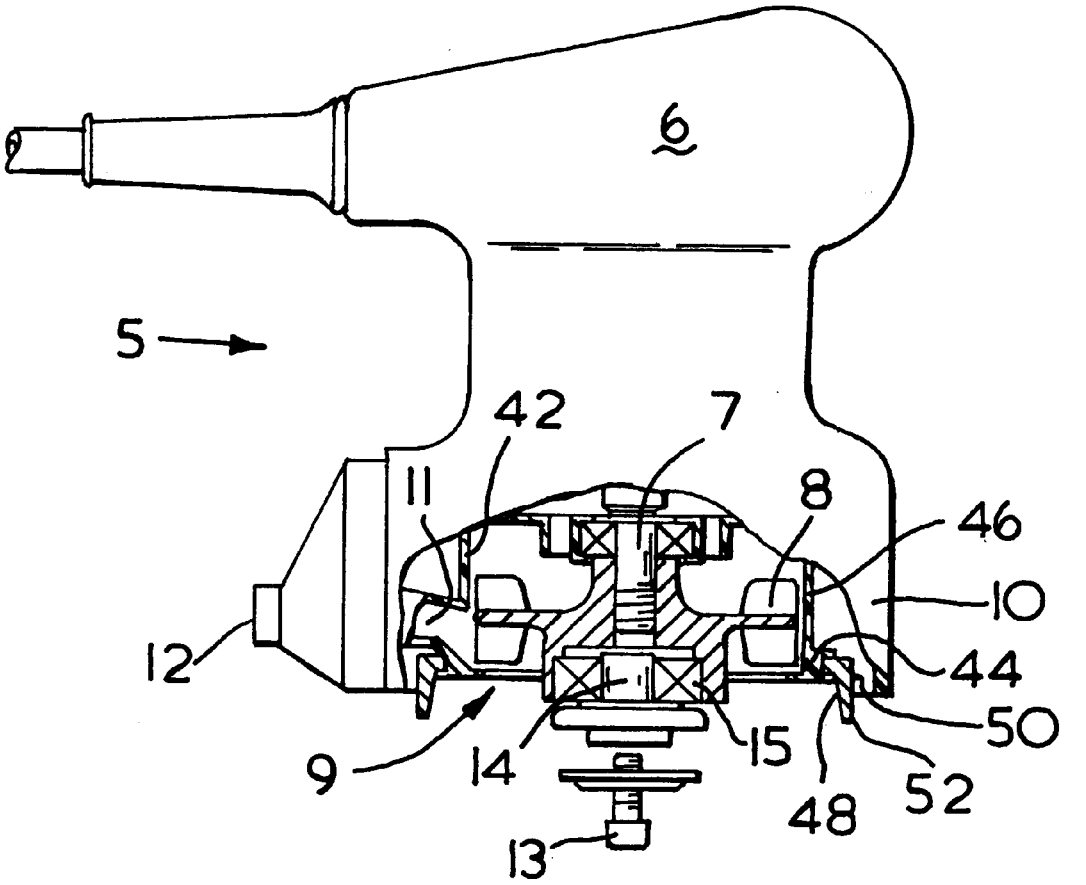
FIG. 4 is a side view, partially in section of the drive unit of a second embodiment of a hand tool according to the present invention, shown without an operating head.
Figure 5:
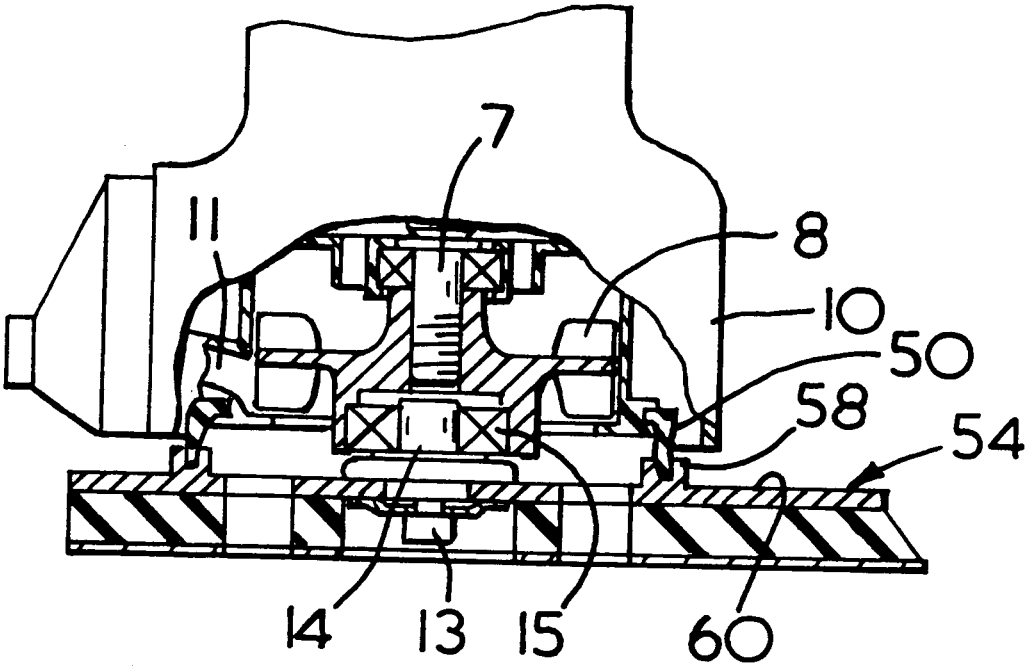
FIG. 5 is a side view of the lower part of the drive unit of FIG. 4 when fitted with an orbital sander shoe.
Figure 6:
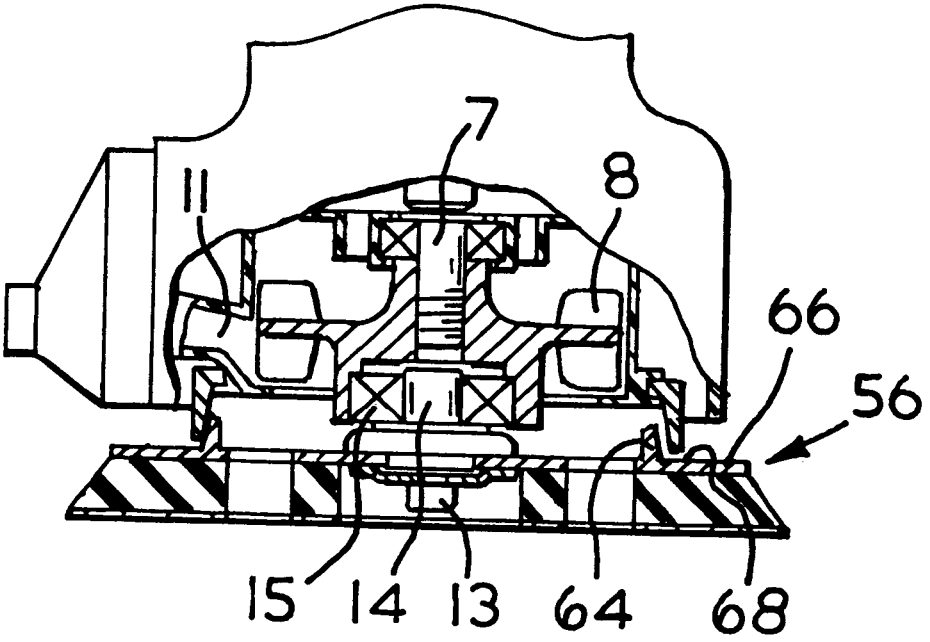
FIG. 6 is a side view of the lower part of the drive unit of FIG. 4 when fitted with a random orbit sander platen.

In a second embodiment shown in FIGS. 4 to 6 of the accompanying drawings, like components are similarly numbered as in FIGS. 1 to 3.

As can be seen from FIG. 4, the drive unit (5), upper housing (6), drive shaft (7), fan (8), mouth (9), lower housing (10), duct (11), outlet (12), screw (13), shaft (14 and bearing (15) are as described with reference to FIGS. 1 to 4.

A shroud (42) surrounds the fan (8), within the lower housing (10) and a flange (44) is provided at the lower end of a wall (46) of the shroud (42). A plurality of location slot (48) are formed in the flange (44) and are adapted to receive corresponding location pegs (50) of an annular brake ring (52). This brake ring (52) is formed of a flexible material, for example rubber, and when attached to the shroud (42) depends from that shroud and projects beyond the lower housing (10).

Drive (5) can alternatively be fitted with an orbital sander shoe (54), (FIG. 5) or a random orbit sander platen (56), (FIG. 6).

As can be seen in FIG. 5, the shoe (54) is driven by the electric motor through shafts (7,14). A slotted groove (58), suitably made from a thermoplastic material, is provided on the upper surface (60) of the shoe (54), and is preferably moulded integrally with the shoe backing plate (62). As the shoe (54) is mounted on the shaft (14), the brake ring (52) engages in the groove (58).

As can be seen from FIG. 6, the shoe (54) may be removed and replaced by a random orbit platen (56). A raised ring (64), suitably made from a thermoplastic material and moulded integrally with the platen backing plate (66), is provided in the upper surface (68) of the platen (56). As the platen (56) is mounted on the shaft (14), the raised ring (64) engages in the brake ring (52).

In operation, in the orbital mode the brake ring (52) engages in the groove (58) and restricts the motion of the shoe (54) to a conventional orbital motion. In the random orbit mode, the platen ring (64) engages with, and rolls around the internal circumference of the brake ring (52), thus limiting the rotational speed of the platen (56) and significantly reducing the stop time when the power supply to the unit is interrupted.

Figure 7:
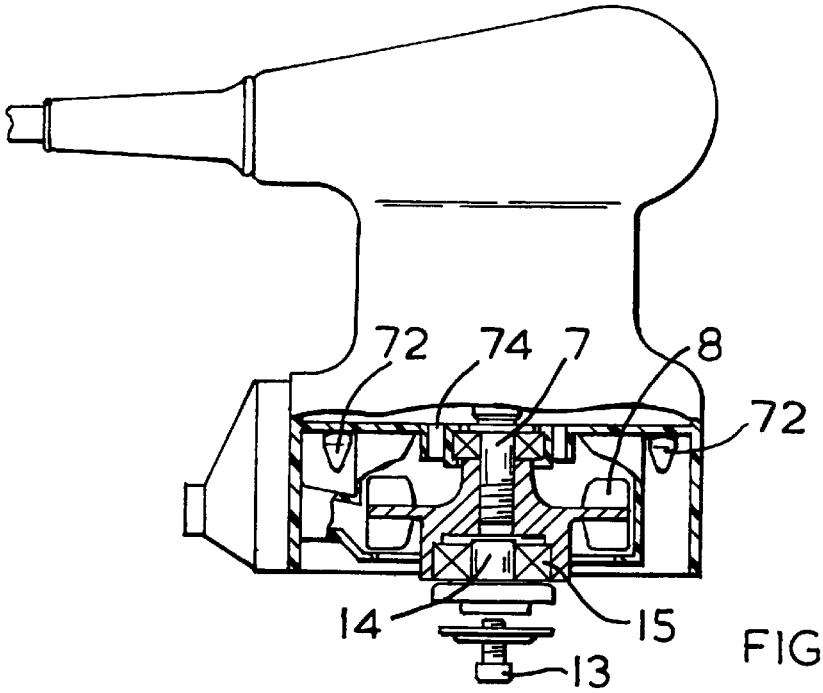
FIG. 7 is a side view, partially in section, of the drive unit of a third embodiment of a hand tool according to the present invention, shown without an operating head.
Figure 8:
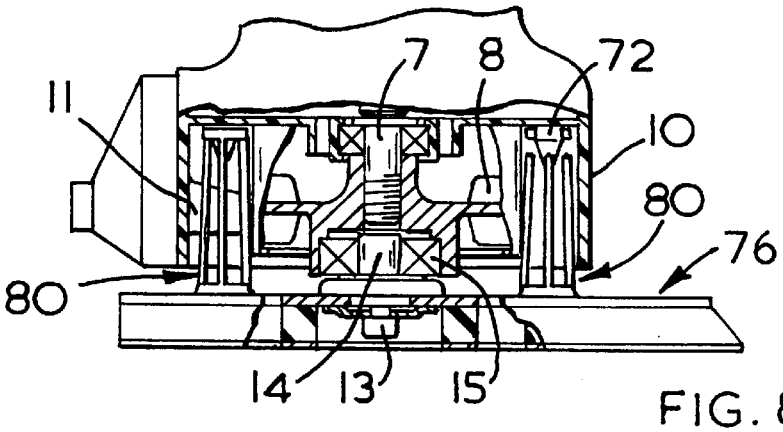
FIG. 8 is a side view of the lower part of the drive unit of FIG. 7 when fitted with an orbital sander shoe.
Figure 9:
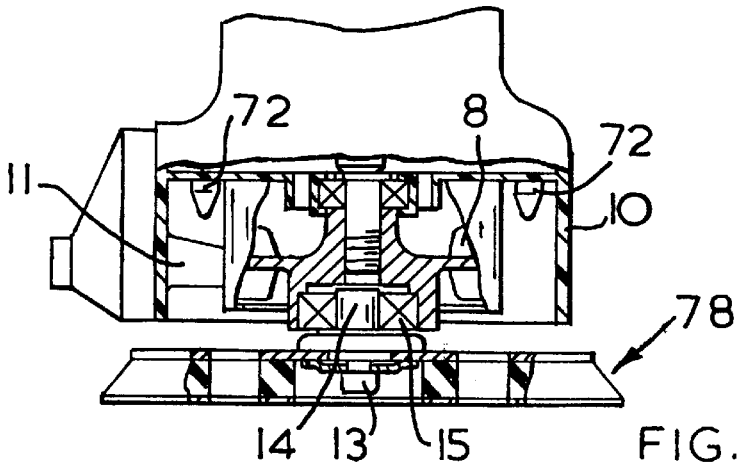
FIG. 9 is a side view of the lower part of the drive unit of FIG. 7 when fitted with a random orbit sander platen.

In a third embodiment shown in FIGS. 7 to 9 of the accompanying drawings, like components are again numbered as in FIGS. 1 to 6.

In this embodiment, as can be seen from FIG. 7, four upstanding spigots bosses (72) are provided on the underside of the floor (74) of the motor housing. These spigots (72) are suitably made of a thermoplastic material and are preferably integrally moulded with the floor (74) of the motor housing.

Drive unit (5) can alternatively be fitted with an orbital sander shoe (76), (FIG. 8) or with a random orbit sander platen (78), (FIG. 9).

As can be seen from FIG. 8, four hollow legs (80) are provided on the backing plate of the shoe (76). As the shoe (76) is mounted on the shaft (14), each of the legs (80) engages a corresponding spigot (72). The legs (80) are shaped for engagement with the spigots (72) and may be made of any flexible material, eg rubber or a synthetic plastics material, and may be welded, screwed, bonded, integrally moulded with or fastened by any appropriate means to the shoe (76).

As can be seen from FIG. 9, the shoe (76) may be removed and replaced by a random orbit sander platen (78). If it is wished to provide braking for the sander in the random orbit mode, then a separate brake must be provided in a manner known per se.

In operation, in the orbital mode, each of the legs (80) engages in a corresponding spigot (72) and the motion of the shoe is restricted to a conventional regular orbit. In the random orbit mode, the platen is free to rotate in a random orbit.

In the embodiment shown in FIGS. 7 to 9, the legs are attached to the shoe, and engage in spigots in the drive unit. It is, however, within the scope of the invention for the legs to be attached to the drive unit and engage with spigots on the backing plate of the shoe. With this variation, it is possible for the legs to provide a braking effect in random orbit mode, thus obviating the need for a separate brake component.

While the powered oscillating hand tool according to the invention is particularly adapted for use with sanding heads such as random orbit sanding platens and orbital sanding shoes, it is of course within the scope of the invention to provide a tool to which further alternative oscillating heads can be attached.

What is claimed is:

1. A dual function powered oscillating hand tool comprising:

(i) a drive unit having an electric motor and a drive shaft;

(ii) a bearing mounted on said drive shaft and located radially eccentrically relative to said drive shaft;

(iii) a second drive shaft mounted on the eccentric bearing;

(iv) means for mounting a sanding head on said second drive shaft for random orbit; and (v) means selectively engageable for restricting said random orbit of said sanding head to a regular orbit, the sanding head being structured as a sanding platen for random orbit and as a sanding shoe for regular orbit.

2. A dual function powered oscillating hand tool according to claim 1 further wherein said means selectively engageable to restrict said random orbit of said sanding shoe to a regular orbit comprises a flexible component and a rigid component, one of which components is mounted on said shoe and the other of which is mounted on said drive unit.

3. A dual function powered oscillating hand tool according to claim 2 further wherein said flexible component comprises a plurality of flexible legs located on said shoe and said rigid component comprises a similar number of rigid location points mounted on said housing and arranged for engagement with said flexible legs, when said shoe is mounted on said second drive shaft.

4. A dual function powered oscillating hand tool according to claim 3 further wherein said flexible legs are hollow, and said rigid location points are bosses which engage in said hollow legs.

5. A dual function powered oscillating hand tool according to claim 1 wherein said tool comprises a brake which is operative in said random orbit mode.

6. A dual function powered oscillating hand tool according to claim 5 wherein said means selectively engageable to restrict said random orbit of said sanding platen to a regular orbit includes a flexible component which is located on said drive unit and is a component of said brake.

7. A dual function powered oscillating hand tool according to claim 2 wherein said flexible component of said means selectively engageable to restrict said random orbit of said sanding shoe to a regular orbit comprises a flexible ring.

8. A dual function powered oscillating hand tool according to claim 7 wherein said flexible ring is a rubber ring.

9. A dual function powered oscillating hand tool according to claim 2 wherein said flexible component of said means selectively engageable to restrict said random orbit of said sanding shoe to a regular orbit comprises a flexible post with a trailing leg.

10. A dual function powered oscillating hand tool according to claim 2 wherein said flexible component of said means selectively engageable to restrict said random orbit of said sanding shoe to a regular orbit comprises a flexible post, trapped between a first captivator located on said housing and a second captivator located on said shoe.

* * * * *